United States Patent [19]

Bäckerud

[11] Patent Number: 4,667,725

[45] Date of Patent: May 26, 1987

[54] METHOD FOR PRODUCING CAST-IRON, AND IN PARTICULAR CAST-IRON WHICH CONTAINS VERMICULAR GRAPHITE

[75] Inventor: Stig L. Bäckerud, Lidingö, Sweden

[73] Assignee: Sinter-Cast AB, Viken, Sweden

[21] Appl. No.: 863,260

[22] PCT Filed: Sep. 10, 1985

[86] PCT No.: PCT/SE85/00339

§ 371 Date: May 7, 1986

§ 102(e) Date: May 7, 1986

[87] PCT Pub. No.: WO86/01755

PCT Pub. Date: Mar. 27, 1986

[30] Foreign Application Priority Data

Sep. 12, 1984 [SE] Sweden ..... 8404579

[51] Int. Cl.[4] ..... B22D 46/00

[52] U.S. Cl. ..... 164/4.1; 164/150; 164/154

[58] Field of Search ..... 164/4.1, 150, 154

[56] References Cited

U.S. PATENT DOCUMENTS 4,333,512 6/1982 Sugiura et al. ..... 164/150
4,598,754 7/1986 Yen et al. ..... 164/4.1

FOREIGN PATENT DOCUMENTS 2849598 6/1979 Fed. Rep. of Germany ..... 164/4.1
350606 10/1971 Sweden ..... 164/4.1
7805633 11/1978 Sweden ..... 164/4.1

*Primary Examiner*—Nicholas P. Godici
*Assistant Examiner*—Samuel M. Heinrich
*Attorney, Agent, or Firm*—Cushman, Darby & Cushman

[57] ABSTRACT

Method for producing castings from cast-iron containing structure-modifying additives. A sample from a bath of molten iron is permitted to solidify during 0.5 to 10 minutes. The temperature is recorded simultaneously by two temperature responsive means, one of which is placed in the center of the sample and the other in the immediate vicinity of the vessel wall. The dispersion degree of the graphite phase is assessed in relation to known reference values by aid of recorded values of supercooling at the vessel wall, the recalescence at the vessel wall, the difference between the temperature at the vessel wall and at the centrum of the vessel and the derivative of the temperature decrease at the vessel wall during the time of constant eutectic growth temperature at the center. When necessary a graphite nucleating agent is added to the molten bath or the dispersion is lowered by implementing a holding time prior to casting. The morphology of the graphite precipitation is also determined by aid of recorded values and possibly corrected by changing the amount of structure-modifying agents present.

5 Claims, 4 Drawing Figures

Figure 1:
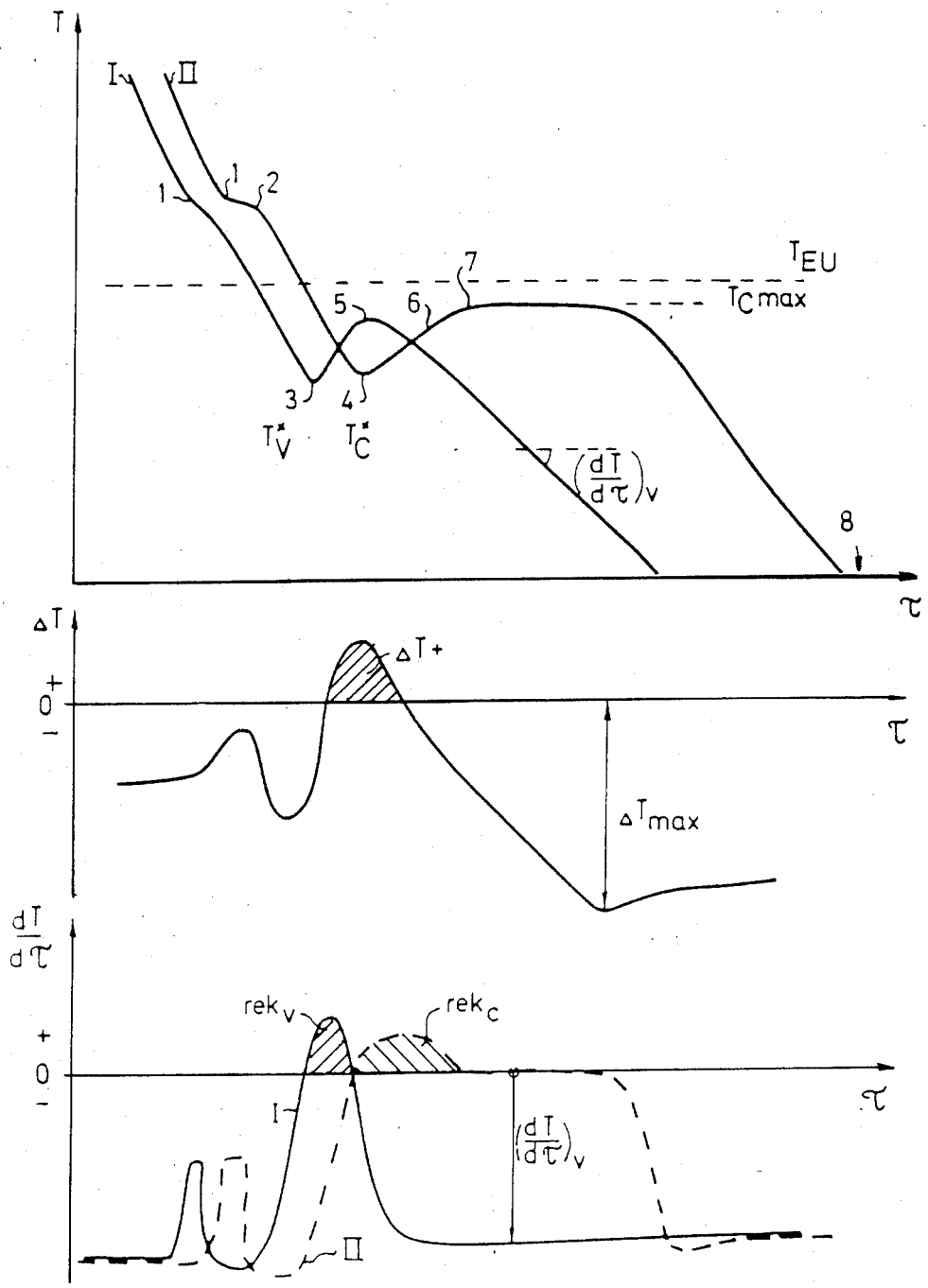

METHOD FOR PRODUCING CAST-IRON, AND IN PARTICULAR CAST-IRON WHICH CONTAINS VERMICULAR GRAPHITE

The present invention relates to a method for producing cast-iron containing structure modifying additives, and preferably additives which will cause carbon to precipitate in vermicular graphite form.

Vermicular graphite is defined as "Form III"-graphite in ISO/R 945-1969, and alternatively "Type IV"A according to ASTM Specification A 247.

Cast-iron is one of the most essential materials in industrial casting processes, and upon solidifying may precipitate carbon in cementite, $Fe_3C$ form, to form white cast-iron or in graphite form, to form grey cast-iron. White cast-iron is brittle, but has a high compression strength and is highly resistant to wear. Grey cast-iron can be readily worked and has an extremely wide field of use within machine technology. In grey cast-iron graphite is normally precipitated in flake form. This results in a cast-iron of limited rupture strain (0.5%). Grey cast-iron has good thermal conductivity, but undergoes permanent changes in volume at elevated temperatures, which restricts its use for some purposes. Consequently, attempts have been made to change the morphology of the precipitated graphite, by incorporating certain additives. In this respect, magnesium, or magnesium in combination with rare earth metals like cerium, has normally been used, these modifying additives preventing the growth of flaky graphite and resulting in a graphite in the form of small spheroids or nodules. This material is known as nodular cast-iron or spheroidal-nodular iron. The use of nodular iron as a construction material has grown widely within the construction field. Additional developments within this field have involved the creation of other graphite morphologies, of which the majority have obtained but limited technical use. It has been found, however, that so-called compacted graphite cast-iron, or so-called vermicular iron, has properties which render it of particular interest, and which give it a superiority over grey cast-iron and nodular iron in respect of many different areas of use. Minor deviations from desired additive quantities and the presence of impurities, however, are factors which make it impossible to use cheap raw materials, and hence manufacture has been restricted to a few foundries which have built-up an expertise by carrying out large numbers of tests and experiments and by using raw materials and additives which are well defined through experience and which are often expensive.

There is therefore an obvious need for a method by means of which preparation of any molten bath of cast-iron material can be controlled in a manner to bring the bath to solidify to vermicular iron with a reproduceable result.

In the casting of metals, great importance is placed on the composition of the molten bath, although the physical state and other factors influencing the course followed by crystallisation of the bath-constituents are also factors of decisive importance with respect to the final properties of the end product.

The chemical composition of the bath, such as alloying elements, impurities, gas content, etc., can be quickly monitored and checked with the aid of modern analysis apparatus, enabling necessary corrections to be made.

On the other hand, however, no method has yet been fully developed by means of which it is possible to predict and control swiftly and reliably the nature of the crystal structure which a given bath of molten material will obtain upon solidifying under prevailing solidification conditions, even though many experiments and tests carried out to this end are found described in the relevant literature, and many patent applications relating to such methods have been filed.

Casting materials can be divided into two main groups, depending on the nature of the solidification process, of which main groups the first includes material which solidify in a single phase (primary solidification processes). This group incorporates most types of steel, aluminium alloys and copper alloys. The other group incorporates materials which solidify in two or more phases (secondary solidification processes). Examples of materials belonging to this group are various types of cast-iron silumin-type aluminium alloys (Al, 8–12% Si).

Accordingly, the object of the present invention is to provide a method for controlling secondary solidification processes, primarily in the solidification of molten cast-iron, so as to obtain compacted graphite cast-iron or vermicular cast-iron from starting materials comprising conventional, readily available iron raw materials and steel scrap, which has not previously been possible.

To this end there is used a thermal analysis technique in which the temperature prevailing in various parts of a sample taken from the molten bath in question is measured and recorded in dependence of time.

This temperature-time recording technique is not novel per se, but is a classic method of determining conversion temperatures and fusion temperatures. Crystalline conversion normally takes place at given temperatures or within given temperature ranges.

In such techniques, a temperature responsive device, such as a thermometer, a thermoelement, a thermistor or the like, is located in or placed in contact with a sample or test vessel, which is heated or allowed to cool in accordance with a set program. The conversion temperature is recorded, as is optionally also the derivative of a solidification curve, or the difference measured between corresponding values for a known reference material.

The method has been used within the field of metallurgy to carry out rapid chemical analyses, for example to determine the so-called carbon equivalent $$\left(CE = \text{total carbon content in percent} + \frac{\%\ \text{Si} + \%\ \text{P}}{3}\right)$$

in cast-iron, by pouring a sample of the bath into a foundry-sand sample beaker having a thermoelement placed centrally therein. When iron crystals (austenite) form from the molten material, a plateau can be read-off from the solidification curve, this plateau disclosing the carbon equivalent in accordance with the calibration of the sampling method applied. This, the apparatus conventionally used is principally suited for effecting a quick assay of the composition of the iron, but reveals nothing with respect to the possible crystalline form of the austenite formed. Such apparatus is sold, inter alia, by the American company Leeds & Northrup under the trade mane "TECTIP".

Similar apparatus have also been used to determine the eutectic growth temperature in the iron-carbon-silicon-system, and for determinating the extent of supercooling prior to the eutectic reaction. The measuring results obtained herewith, however, give no satisfactory indication of the crystalline structure which can be expected upon solidification of the molten bath and during the aforesaid eutectic reaction. In apparatus such as these in which the molten material is poured into a cold mold, there is namely formed momentarily a skin of solid phase close to the cold wall of the mold, where iron with a graphite phase and iron with a carbide phase occur, and at the relevant growth temperatures for respective phases the said phases are able, quite simply, to grow without having reached supercooling critical to effect new or renewed nucleation.

A critical review of the usefulness of this method in respect of nodular cast-iron has recently been published in AFS Transactions 82:131, pages 307–311. This review shows that reliability in accuracy afforded by this method in determining structures lies at a confidence level of 80%, which is quite unsatisfactory with regard to commercial production methods.

Still worse results can be expected when attempting to prophecy the formation of vermicular graphite, which requires the measuring method to be far more accurate.

These fundamental deficiencies in current thermal analysis techniques, have, however, been partially overcome by the technique described in Swedish Patent Specification No. 350 606.

With this technique it is possible to measure factual supercooling and growth temperatures during the formation and growth of crystals, by immersing the sampling vessel in the molten bath or heating the vessel in some other way, so that both the sampling vessel and its contents have reached thermal equilibrium at a temperature above the temperature of crystallisation prior to commencement of the cooling process. An improved indication of the various crystalline growth phenomena during the process of solidification can be had by measuring the supercooling temperature prior to nucleation, recalescence (re-heating by released heat of crystallisation) strength and duration (represented simplest by the maximum value and duration of the positive derivative). An essential problem remains, however, when measuring the eutectic reaction of cast-iron; the recalescence function and growth temperature are not solely contingent on the growth form, but also on the concentration of the graphite crystals formed (=number of graphite crystals per unit volume) and the method allows no distinction between these two factors, such distinction being necessary in order to predict the structural formation and to enable the process to be influenced in the right direction.

It is possible to determine other properties of the solidified material, for example the dimensional change (with dilatometry) or the thermal conductivity in a fully solidified sample, about 100° C. beneath the solidifying temperature, (Swedish Patent Application No. 7805633-0). It is not possible, however, with the aid of these methods to determine structural formation with sufficient accuracy, either with respect to morphology or with respect to the degree of dispersion of the graphite phase.

It is now possible as a result of the present invention to establish reliably the structural formation of a solidifying bath during the actual solidification process, by applying a newly developed technique based on thermal analysis. According to this novel technique, a sample quantity taken from the molten bath in question is transferred to a sampling and testing vessel which is heated to thermal equilibrium between the vessel and the molten sample contained therein, at the temperature above the crystallisation temperature, and a recording is made of the change in temperature taking place with time at the centre of the sample and at a location immediately adjacent the wall of the sample vessel. In this way there are obtained two mutually separate solidification curves which are able to provide more complete information regarding the process of solidification during casting. (Hereinafter reference is made solely to a sample vessel, although it will be understood that by this is also meant a test vessel.)

The present invention relates to a method for producing castings from a cast-iron melts containing structure modifying additives, characterized by producing an initial cast-iron bath; removing a sample quantity of the bath with the aid of a sampling vessel; causing the sample quantity to solidify from a state in which the sampling vessel and the sample quantity are substantially in thermal equilibrium at a temperature above the crystallisation temperature of the bath; and allowing the sample quantity to solidify fully over a period of from 0.5 to 10 minutes, the temperature-time-sequence being measured and recorded simultaneously by two temperature responsive means, of which one is placed in the centre of the sample quantity and the other in the molten material closely adjacent the wall of the sampling vessel. The degree of dispersion of the graphite phase in relation to known reference values for the same sampling process is assessed with the aid of the temperature measured during the first crystallization events in the molten material at the vessel wall, the recalescence at the vessel wall ($rek_v$), the positive difference between the temperature at said wall and in the centre of the sample quantity ($\Delta T+$), and the temperature gradient in the sample behind the eutectic growth front expressed as ($dT/d\tau$) ($T_c max$) (approximately constant at least for a short period during the eutectic growth in the centre of the sample quantity $(dT/d\tau)_c=0$) optionally expressed as the greatest negative values ($\Delta T_{max}$) of the temperature difference, wherewith in the event that the molten bath has an insufficiency of crystallisation nuclei a graphite nucleating agent is introduced thereinto, and conversely when it is found that the crystallisation nucleants are in excess, this excess is reduced. The morphology of graphite precipitation is determined in relation to known reference values for the same sampling process, with the aid of the crystallisation temperature at the centre of the bath ($T^*_c$), the recalescence at the centre ($rek_c$) and the maximum growth temperature ($T_c max$), and the quantity of structure modifying agent present is corrected so that graphite is precipitated in a vermicular form during solidification of the cast-iron melt after casting.

Figure 2:
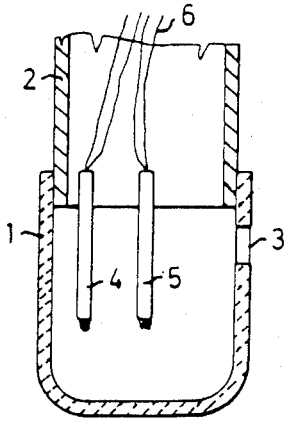
Figure 3:
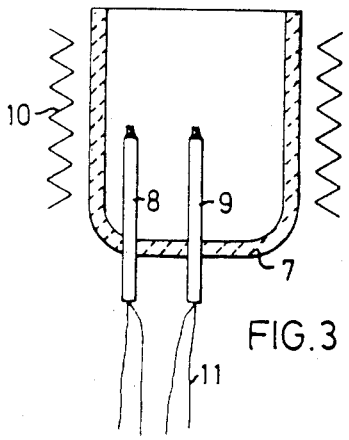
Figure 4:
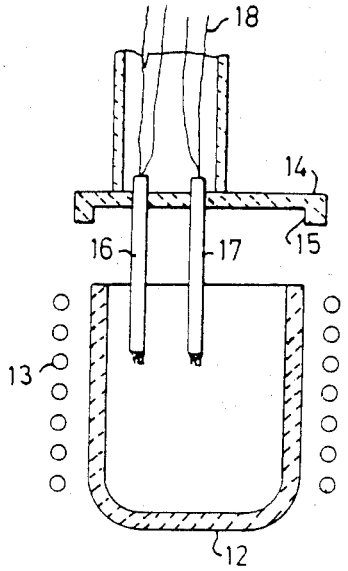

The invention will now be described in more detail with reference to the accompanying drawings, in which FIG. 1 is a graphic presentation of a solidification diagram derived from measurement values obtained when producing vermicular cast-iron and FIGS. 2, 3 and 4 illustrate various exemplary embodiments of sampling vessels appropriate for use when practising the method according to the present invention.

FIG. 1 thus shows temperature (T)-time ($\tau$)-curves of which curve I represents the course of solidification at a location close to the wall of the sampling vessel, and curve II represents the course of solidification at the centre of the sample in the vessel.

Referring to both curves, reference 1 indicates the point at which there is a fall in the temperature decrease per unit of time due to heat generated by the formation of the primary phase austenite. The reference 2 on curve II illustrates the point at which austenite crystals (in dendritic (branched) form) have formed throughout the whole of the sample quantity. Subsequent hereto, the molten sample material is enriched between the austenite crystals with carbon (and other alloying elements) so that gradually, as the decrease in sample temperature continues, the eutectic composition is reached.

The reference 3 on curve I indicates the point at which the temperature drop terminates. Graphite crystals are formed at the vessel wall with sufficient supercooling, and these graphite crystals grow together with the iron phase in an eutectic mixture. After this stage in the solidification process, the molten sample is reheated (through recalescence) towards the equilibrium termperature of the eutectic mixture. This is marked with a broken line $T_{Eu}$ in FIG. 1. At this early stage of the eutectic reaction, however, a steady state in the growth in relation with growth inhibiting mechanisms has still not been fully reached and the rate at which recalescence takes place therefore denotes substantially the number of active graphite nuclei per unit of volume. Similarly, the reference 4 in curve II indicates the point of maximum supercooling, $T^*_c$: 6 indicates the recalescence curve; and 7 indicates the current growth temperature at steady state in the centre of the sampling vessel. These values provide information relating to the growth mechanism at the state of eutectic solidification.

The temperature at the wall can be said to represent a "momentary image" of the course of crystallisation in a restricted volume of molten material (thin wall) and the temperature in the centre of the vessel represents an "integrated" image of the thermal behaviour throughout the whole of the interior of the sample. The temperature along the radius in the sample quantity between the two measuring locations will include a temperature wave which propagates forwardly and reflects the growth sequence along an inwardly advancing eutectic solidification front. This means in practice that the outer thermoelement registers a solidification process corresponding to that in thinwalled castings, while the central thermoelement provides information concerning the solidification sequence in thicker parts of the casting. Only when possessing this combined information is it possible to draw conclusions concerning the ability of a molten material to form a desired structure in castings of varying thickness during a casting and solidifying process.

This description of the solidification process is mainly related to hyper-eutectiod cast-iron compositions. The method can also be applied, however, to cast-iron of eutectic and hyper-eutectic composition. Primary crystal growth does not occur upon the solidification of a eutectic composition, and will only occur with respect to a primary graphite precipitation in the case of hyper-eutectic compositions.

It has been found experimentally that when insufficient supercooling, weak recalescence and high growth temperature prevail during the solidification process, a flaky graphite is formed.

On the other hand, if a high supercooling temperature, small recalescence and low growth temperature prevail, this signifies that the graphite will solidify in a nodular form and that nodular cast-iron, or spheroidal nodular iron, will be obtained.

When vermicular graphite is disassociated during solidification, there is obtained a high supercooling, a strong recalescence and a high growth temperature.

The deviations exhibited by the curves are sufficiently pronounced to permit a fine graduation to be made within these main groups, and it is thereby possible to predict the formation of vermicular graphite with a high degree of certainty, which in turn enables the process to be controlled to within fine limits.

Assuming that external conditions remain the same from case to case, it is possible to make comparisons between the two values recorded by the temperature responsive means located adjacent the wall of the sampling vessel and in the centre of the molten sample quantity and between different tests on the molten bath. It is, of course, necessary that differences in technique and the geometry of the sampling vessel and the material located therein are so small that reproduceable and comparable results can be obtained from different samples.

A number of sampling vessels suitable for use when carrying out the solidification test will be described hereinafter with reference to FIGS. 2–4. The methodology applied, must, of course, be the same with each sample or test, such that temperature equilibrium is achieved between molten material and sampling vessel. The temperature around the sampling vessel is regulated so that heat is lost from the sampling vessel in a manner which enables the molten material to solidify over a period of 0.5–10 minutes. The lower limit is governed by the fact that more rapid cooling results in the formation of cementite in accordance with the metastable system. Slower cooling than 10 minutes is impractical from the aspect of production and, moreover, the accuracy of the measuring results obtained is impaired by other reactions taking place in and around the vessel and by convection. An ideal cooling period is from 2 to 4 minutes. The dimensions of the sampling or testing vessel are not so critical, although for practical reasons the diameter of the vessel should not be smaller than about 2 cm or greater than about 10 cm. A suitable diámeter is from 3 to 6 cm, and it will be understood that the vessel is suitably filled to a height of some centimeters and that the height of the fill of the sample must be greater than its diameter. It is preferably ensured that heat is lost from the sampling vessel in essentially a radial direction. This can be achieved by insulating the upper and lower surfaces of the sample quantity.

Although the sampling technique applied may vary from series to series, it must, of course, be the same within a particular sample series to be compared. When sampling the molten bath material, the sampling vessel may, for example, be immersed in the molten bath and held there until it is heated to the temperature of the bath. Alternatively, the sampling vessel may be preheated to bath temperature and then filled with molten bath material, while another suitable method is one in which the test vessel and the molten sample contained therein are placed in a separate oven or kiln prior to recording the solidification curve, and there heated to equilibrium. Repeated tests can be carried out, by immersing a sampling vessel into the molten bath and recording the solidification curve of the sample taken, and then re-immersing the vessel, together with the solidified sample, into the bath, so that the solidified sample is re-smelted and the vessel refilled with a fresh sample.

The release of latent heat and the eutectic growth front (which is dependent on the pertinent growth mechanism) and the thermal conductivity of the solidified layer behind the front are highly dependent on both the number of graphite crystals in the eutectic structure and the form of said crystals. A suitable method of determining this composite function is obtained by determining the slope ($dT/d\tau$) obtained during solidification through the agency of the temperature responsive means located adjacent the vessel wall over that period of time during which the temperature responsive means located in the centre of the vessel records a plateau temperature (corresponding to the temperature at eutectic steady state $T_c$max, a time period over which $(dT/d\tau)_c$ is thus equal to zero. This composite function can also be determined by measuring the maximum difference ($\Delta T_{max}$) between the two curves during the process of solidification. It is found that the values change for different graphite forms in the cast-iron in both cases. Grey cast-iron comprising flaky graphite produces but small temperature differences between the two solidification curves. Nodular iron produces large values of $\Delta T_{max}$, whereas cast-iron solidifying to vermicular iron produces values therebetween, therewith providing splendid possibilities for differential assessment of the solidifying properties of respective molten baths.

At the eutectoid transition (in solid phase from austenite to ferrite and cementite (point 8) the rate, and therewith the final structure, can be followed in detail by comparing deviations from the two measuring points, and particularly by comparing the time displacement and magnitude of the derivated functions.

In addition to the aforedescribed possibility of recording double solidification curves from an unknown sample and comparing the configuration of these curves with corresponding curves obtained from samples of known crystallising characteristics (either graphically or in some other recording medium, such as a data processor), the following properties are characteristic when producing cast-iron containing graphite which solidifies to vermicular form.

The most reliable method of ascertaining the vermicular growth form is to utilize to this end the supercooling in the centre ($T^*_c$), the recalenscence sequence ($rek_c$) and the eutectic maximum growth temperature ($T_c$max).

The actual degree of dispersion (here defined as the number of graphite crystals/unit volume) can be determined by the recalescence sequence at the wall ($rek_v$), $\Delta T_{max}$ or alternatively $(dT/d\tau)_v$ at $T_c$max through the temperature curve of the first eutectic nucleation events. The first nucleation events are normally encountered as the degree of supercooling, $T^*_v$, but in the case of very effective graphite nucleation an arrest in the cooling curves indicates the formation of small amounts of flaky graphite.

All of the magnitudes recited here can be measured with a precision and reproduceability which enables the inherent crystallisation properties of the molten bath to be asesssed.

It is not always necessary to use all of the aforesaid variables, since these variables are interrelated, as will be evident from the aforegoing, and consequently in a well-calibrated system it is sufficient to use only a few of said variables, and in certain cases solely one or the other of said variables, in order to determine the crystallisation properties of an individual molten bath. In systems such as these it is possible to obtain the major part of the relevant information from a single eccentrically located thermoresponsive means.

One skilled in foundry technique is well able to determine which of the suggested data shall be chosen for practical production of a stable vermicular cast-iron and in which manner the measuring data shall be recorded and evaluated. Naturally, the simplest method is to compare calibrated standard curves with recorded curves based on the measuring values obtained, although these values can also be compared in digital form through automatic data processing.

For the purpose of clarifying these various possibilities, FIG. 1 illustrates graphically curves in which time $\tau$ is plotted against the difference between the two curves; curve I minus curve II$=\Delta T$, and where the region of the positive $\Delta T$-values is illustrated by a hatched region, and finally ($dT/d\tau$) has been drawn for the two curves, where the aforesaid values are illustrated in derivated form, $rek_v$ and $rek_c$ being shown as hatched areas of positive value.

Thus, it is possible to read from the graphic curve those measures which should be taken in order to obtain a desired result, and then to show that the desired result has been achieved, optionally by taking further samples and carrying out further tests. Knowledge of the crystallisation properties of the molten bath enables necessary additions or necessary removal of relevant substances to be made, and it also lies within the expertise of one skilled in the art to measure the crystallisation properties fully automatically and then correct automatically the composition of the molten bath with the aid of data-programming techniques, so as to obtain vermicular cast-iron. The rate of solidification will be dependent on the thermal conductivity of the vessel wall, the wall thickness, the volume-surface-ratio of the sample and the ambient temperature. Although all of these parameters can be varied, it will be understood that they must be adapted to enable the sampling or testing method to be carried out in a practical manner and be adapted for intended castings of various dimensions.

The sampling vessel is cooled most simply in atmospheric air at ambient temperature, although it may also be convenient to prolong the course of solidification, by causing solidification to take place in an oven at a temperature between the melting point of cast-iron and the ambient temperature. The solidification time can also be extended by isolating the sampling vessel, or by placing the vessel in an insulating jacket during the solidification process. If desired, the solidification process can also be accelerated with cooling air, dim-spray or some similar expedient. It is not possible to describe in general terms the form which a sampling device shall take, although it lies within the expertise of one skilled in this art to devise the sampling and testing method in a manner to achieve the conditions recited in the following claims.

Prior to commencing the measuring process, the entire arrangement, sampling vessel, temperature chamber and the molten material present therein must be substantially in thermal equilibrium at a temperature above the melting point of the sample. This represents a temperature of about 1200°–1400° C. in the case of cast-iron.

This state of equilibrium can be reached, for example, by constructing the sampling vessel together with the temperature responsive means in a manner which will enable them to be immersed in a molten bath heated to a temperature of about 1200°–1400° C. and held in the bath until the whole arrangement is heated to this temperature, and then removed from the bath and allowed to cool. The temperature responsive means are therewith connected to some form of recording device, which stores measuring data in analogue or digital form.

It will therefore be understood that the sampling or testing vessel can be constructed in different ways, and three embodiments of suitable sampling or testing vessels are illustrated in FIGS. 2–4.

FIG. 2 illustrates an embodiment of a suitable sampling or testing vessel for immersion into a hot molten bath, said vessel comprising a sleeve 1 of heat resistant material, suitably a ceramic material. The sleeve 1 is attached to a tubular member 2 by means of which the vessel can be held and immersed into the bath. The sleeve 1 is provided with an opening 3 through which molten material can flow into the sleeve. Arranged in the sleeve 1 are two thermoelements 4 and 5, one being placed in the immediate vicinity of the sleeve wall 4 and the other in the centre 5 of the sleeve. The thermoelements are connected to a recording device (not shown) by conductors 6.

FIG. 3 illustrates another embodiment of a sampling or testing vessel which can be filled with hot bath material for the purpose of making an analysis. The vessel of this embodiment comprises a sleeve 7 having temperature responsive means 8 and 9 inserted through the bottom thereof, the one (8) of said temperature responsive means being placed adjacent the sleeve wall, and the other (9) being placed in the centre of the sleeve. The vessel is surrounded by heating coils 10 for preheating the vessel. The temperature responsive means 8 and 9 are connected to recording devices (not shown) by means of conductors 11.

FIG. 4 illustrates a further embodiment of the sampling or testing vessel, comprising a sleeve 12 which is surrounded by a high-frequency heating device 13 for re-heating the vessel and the sample contained therein. Molten material can be transferred to the vessel with the aid of a ladle. The sleeve 12 of the this embodiment is arranged to co-act with a lid 14 provided with guides 15 for locating the lid on the sleeve 12, and with downwardly extending temperature-responsive means 16 and 17, which are connected to a recording device (not shown) by means of conductors 18. The lid, carrying the temperature-responsive means, is placed on the sleeve 12 subsequent to heating the vessel and the sample contained therein to the requisite temperature.

When practising the invention, there is produced a conventional cast-iron molten bath whose chemical composition is adjusted to desirable values in accordance with chemical analysis. A sample of the bath is then taken for thermal analysis in accordance with the invention, and the solidification curves recorded. The inherent nucleating ability of the molten bath is assessed and any requisite additions of oxide-sulphide-forming agents are made, in order to obtain the desired primary nucleating ability. Examples of suitable oxide and sulphide forming additives include calcium, aluminium and magnesium. Another prerequisite for graphite nucleation is that the carbon equivalent, CE, is sufficiently high. Consequently, nucleation can be facilitated by adding a substance which locally increases the carbon equivalent, CE, such as ferro-silicon quartz or silicon carbide for example. Although the addition of nucleating agents is well known within the art, it has not previously been possible with the aid of known measuring methods to ascertain with sufficient accuracy the need for making such additions prior to casting.

Subsequent to calibrating the system, particularly important information is obtained concerning the nucleating ability of $T^*_v$ and $rek_v$ and $\Delta T$-function. A deficiency in nucleating agents can result in increased supercooling, this increase being so great in certain cases that a transition to the metastable system occurs at the edges of the sampling vessel. An extremely rapid recalescence takes place when white cast-iron solidifies. In order to form nodular iron, the formation of nuclei has to be hundreds of times greater than that required for forming flaky graphite. In order to obtain vermicular iron, the nucleating ability has to be smaller than that required to form nodular iron, suitably in the order of magnitude of one tenth. If an excessively low nucleating ability is measured, a nucleating stimulant can be added, while if it is desired to lower the nucleating ability the molten bath is simply allowed to stand for a given period of time, since the nucleating ability decreases with extended holding times.

The quantity of active structure-modified substances is regulated with respect to supercooling at the centre of the molten material ($T^*c$), the recalescence at the centre of the material ($rek_c$) and the maximum growth temperature ($T_c max$). When the sample solidifies, the amount of active structure-modifying substances present will control the crystal growth. When forming nodular graphite, the growth is restricted in three directions when graphite precipitation has reached a certain level, but if the quantity of active structure-modifying substances is reduced slightly in relation to that required to obtained nodular graphite, crystal growth will be restricted solely in two directions, leaving the possibility for crystal growth from the molten metal to take place in the third direction, such crystal growth then taking place to form worm-like graphite crystals. An analysis of the aforegiven values ($T^*_c$, $rek_c$ and $T_c max$) will reveal whether or not the molten bath contains sufficient structure modifying substances. When this content is found to be insufficient, structure modifying elements are added. Magnesium optionally in combination with rare earth netals, such as cerium may serve this purpose. An excessively high content of structure-modifying substances can be rectified by oxidation, which can be effected by introducing oxygen into the bath, or by adding an oxidising agent, such as magnetite thereto. Oxidation can also be effected by exposing the surface of the metal to air for a period of some minutes. Inhibitors, such as titanium, can also be added to the bath for the purpose of decreasing the content of active structure-modifying substances.

The present invention is primarily intended to solve the problem of controlling casting processes to solidification with vermicular graphite precipitation. Notwithstanding this, however, the method also affords the valuable possibility of accurately determining the dispersion degree when producing grey cast-iron, and therewith to control the type of flaky graphite precipitated. It is also possible to determine accurately the quantity of structure modifying substances and the desired degree of dispersion when manufacturing spheroidal-nodular iron, thereby enabling savings to be made in the use of expensive additives.

Irregularities in the solidification curve obtained when measuring the sample in the centre thereof, towards the end of the solidification phase, can also show possible carbide formation, which in turn provides a valuable indication that there is a deficiency in nucleating agent in combination with the presence of a carbide stabilizing element, being segregated in the microstructure.

It will also be understood that there is always used within the foundry technique a well-tried calibration which is contingent on the local conditions and which incorporates types and structural configurations of melters and optionally devices for melt-treatment, heat-holding and casting of the type of castings to be produced. Available analysis and measuring methods are used in this work to the best possible extent, and the present invention affords herewith a solution to a difficult material-control problem prevailing within the foundry industry.

It will be understood, that when controlling the casting process, a series of mutually different factors can be derived from the solidification curves and the configuration taken by the curve as a whole can be optionally analyzed and compared with the known total process developments. Modern data technology enables significant values to be taken in algorithms and compared with corresponding reference data, enabling the melt-treatment process to be controlled on the basis thereof, optionally in a fully automatized system.

I claim:

1. A method for producing castings from cast-iron containing structure modifying additives, characterized by preparing a molten cast-iron bath; removing a sample quantity of the bath with the aid of a smapling and testing vessel; causing the sample quantity to solidify from a state in which the vessel and the sample quantity are substantially in thermal equilibrium at a temperature above the crystallisation temperature of the bath, and allowing the sample quantity to solidify fully over a period of from 0.5 to 10 minutes, the temperature-time sequence being measured and recorded simultaneously by two temperature responsive means, of which one is placed in the centre of the sample quantity and the other in the molten material at a location close to the wall of the vessel; by assessing the degree of dispersion of the graphite phase in relation to known reference values for the same sampling and testing process with respect to finished castings with the aid of the temperature measured during the first nucleation events of the eutectic reaction measured at said vessel wall represented by ($T^*_v$) taking place, the recalescence at the vessel wall ($rek_v$) the positive difference between the temperature at the vessel wall and in the centre ($\Delta T+$) thereof, and the derivative of the temperature decrease at said vessel wall during the time for constant eutectic growth temperature $(dT/d\tau)_c=0$ in the centre of the sample quantity $(dT/d\tau)_v(T_c max)$, alternatively the highest negative values ($\Delta T_{max}$) of the temperature difference, wherewith in the event that the bath has an insufficiency of crystallisation nuclei a graphite nucleating agent is introduced thereinto, and conversely when the crystallisation nucleants are present in excess the degree of dispersion is lowered by holding the bath for a sufficient time to reduce the amount of nuclei in the bath prior to casting; and by assessing the morphology of the graphite precipitation in relation to corresponding data obtained with the same sampling and testing technique applied with cast iron of known mutual structure with the aid of supercooling taking place in the centre ($T^*_c$) of the molten material, the recalescence in the centre ($rek_c$) and the maximum growth temperature ($T_c max$) and correcting the quantity of structure-modifying means in response thereto so that graphite precipitation takes place in a pre-determined form upon solidification of the molten cast-iron subsequent to casting.

2. A method for producing cast-iron castings according to claim 1, characterized in that the bath contents of both nucleating and structure-modifying agents are controlled so that the molten cast-iron solidifies with graphite in vermicular form subsequent to casting, this being achieved by causing the recorded measuring data to coincide with corresponding data obtained with the same sampling and testing technique applied with cast-iron of known vermicular structure.

3. A method according to claim 1, characterized in that the sample is taken from the molten bath by immersing a sample vessel into the bath and removing said vessel subsequent to filling the same with molten material and heating said vessel to the temperature of the bath.

4. A method according to claim 1, characterized by removing a sample from the molten bath and transferring said sample to a sampling and testing vessel, which is therewith pre-heated to a temperature approximately equal to the temperature of the molten material prior to the sample being allowed to solidify.

5. A method according to claim 1, characterized by removing a sample from the molten bath and transferring the sample to a sampling and testing vessel, and by subsequently heating the vessel and the molten material contained therein to a temperature equilibrium corresponding to the temperature of the molten bath, prior to allowing the sample to solidify.

* * * * *